US010285519B1

(12) United States Patent
Muniz

(10) Patent No.: US 10,285,519 B1
(45) Date of Patent: May 14, 2019

(54) CORNER RETAINERS FOR A PILLOW

(71) Applicant: Noe Muniz, Pomona, CA (US)

(72) Inventor: Noe Muniz, Pomona, CA (US)

( * ) Notice: Subject to any disclaimer, the term of this patent is extended or adjusted under 35 U.S.C. 154(b) by 402 days.

(21) Appl. No.: 15/257,373

(22) Filed: Sep. 6, 2016

(51) Int. Cl.
*A47G 9/10* (2006.01)
*A47C 31/00* (2006.01)
*A47C 23/00* (2006.01)

(52) U.S. Cl.
CPC ..... *A47G 9/10* (2013.01); *A47C 23/007* (2013.01); *A47C 31/00* (2013.01); *A47G 9/1045* (2013.01)

(58) Field of Classification Search
CPC ..... A47G 9/10; A47G 9/1009; A47G 9/1027; A47G 9/1045; A47G 9/0253; A47C 31/00; A47C 23/007; A47C 27/066; A47C 27/22
See application file for complete search history.

(56) References Cited

U.S. PATENT DOCUMENTS 1,020,444 A * 3/1912 Platt ..... A47G 9/10 5/636
1,206,775 A 11/1916 Everts
2,927,330 A * 3/1960 Koenigsberg ..... A47C 27/05 5/717
4,086,675 A * 5/1978 Talbert ..... A47C 27/14 297/DIG. 1
D257,105 S * 9/1980 Morris ..... A47G 9/10 5/636
4,916,765 A * 4/1990 Castronovo, Jr. .... A47G 9/1081 297/284.1
4,949,411 A 8/1990 Tesch
5,265,295 A * 11/1993 Sturgis ..... A47C 27/22 5/655.9
5,636,397 A * 6/1997 Boyd ..... A47C 27/22 5/739
6,151,733 A * 11/2000 Takashima ..... A47G 9/10 5/636
6,490,743 B1 * 12/2002 Adat ..... A47G 9/0253 5/490
D496,205 S 9/2004 Baddour
6,928,677 B1 * 8/2005 Pittman ..... A47G 9/10 5/636
6,928,678 B1 * 8/2005 Chang ..... A47G 9/007 5/636
7,222,379 B2 * 5/2007 DiGirolamo ..... A47G 9/10 5/636

(Continued)

FOREIGN PATENT DOCUMENTS

CA 1317039 C 8/1990

*Primary Examiner* — Robert G Santos
*Assistant Examiner* — David R Hare
(74) *Attorney, Agent, or Firm* — Kyle A. Fletcher, Esq.

(57) ABSTRACT

The corner retainer for a pillow is an insert that is adapted for use with a pillow that is contained within a pillow casing. The pillow casing is formed in a rectilinear shape. The corner retainer for a pillow is inserted into the combination of the pillow contained within the pillow casing such that the corner retainer for a pillow can be subsequently removed. The corner retainer for a pillow is placed in the corner of the pillow casing in such a manner that the pillow corner retainer for a pillow stiffens the pillow casing such that the pillow casing does not appear "floppy." The corner retainer for a pillow comprises a cover, a padding, and a bung. The padding and the bung are contained within the cover.

19 Claims, 6 Drawing Sheets

(56) References Cited

U.S. PATENT DOCUMENTS

| | | | | |
|---|---|---|---|---|
| 8,656,537 | B2 * | 2/2014 | Leifermann | A47G 9/10 5/636 |
| 2005/0050639 | A1 * | 3/2005 | Ruiz | A47C 27/066 5/717 |

* cited by examiner

CORNER RETAINERS FOR A PILLOW

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal or domestic articles, more specifically, an accessory configured for use with a pillow.

SUMMARY OF INVENTION

The corner retainer for a pillow is an insert that is adapted for use with a pillow that is contained within a pillow casing. The pillow casing is formed in a rectilinear shape. The corner retainer for a pillow is inserted into the combination of the pillow contained within the pillow casing such that the corner retainer for a pillow can be subsequently removed. The corner retainer for a pillow is placed in the corner of the pillow casing in such a manner that the pillow corner retainer for a pillow stiffens the pillow casing such that the pillow casing does not appear "floppy."

These together with additional objects, features and advantages of the corner retainer for a pillow will be readily apparent to those of ordinary skill in the art upon reading the following detailed description of the presently preferred, but nonetheless illustrative, embodiments when taken in conjunction with the accompanying drawings.

In this respect, before explaining the current embodiments of the corner retainer for a pillow in detail, it is to be understood that the corner retainer for a pillow is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the corner retainer for a pillow.

It is therefore important that the claims be regarded as including such equivalent construction insofar as they do not depart from the spirit and scope of the corner retainer for a pillow. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
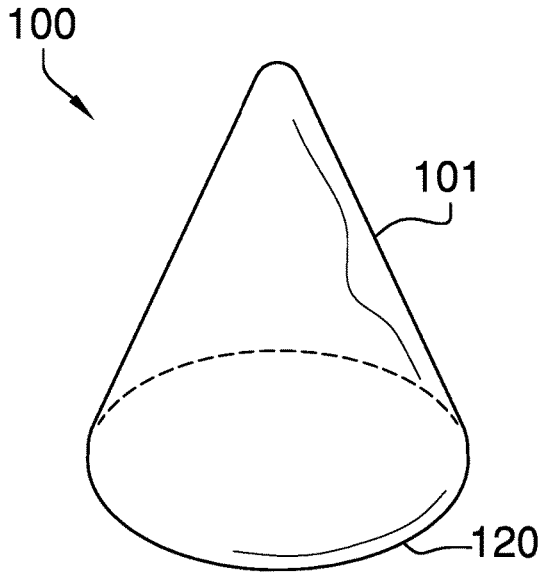
FIG. 1 is a perspective view of an embodiment of the disclosure.
Figure 2:
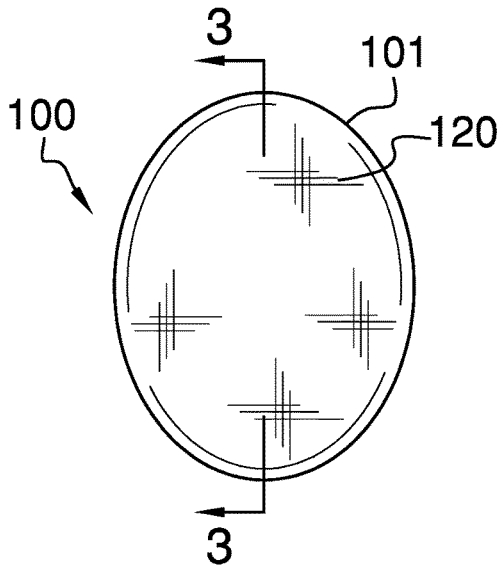
FIG. 2 is a bottom view of an embodiment of the disclosure.
Figure 3:
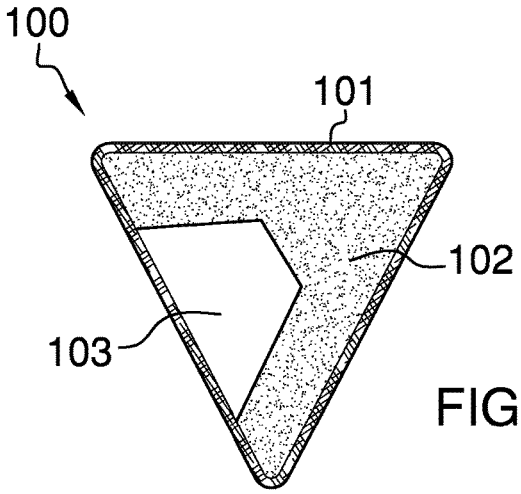
FIG. 3 is a cross-sectional view of an embodiment of the disclosure across 3-3 as shown in FIG. 2.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 8.

The corner retainer for a pillow 100 (hereinafter invention) comprises a cover 101, a padding 102, and a bung 103. The padding 102 and the bung 103 are contained within the interior of the cover 101. The invention 100 is an insert that is adapted for use with a pillow 161 that is contained within a pillow 161 casing 162. The pillow 161 casing 162 is formed in a rectilinear shape. The invention 100 is inserted into the combination of the pillow 161 contained within the pillow 161 casing 162 such that the invention 100 can be subsequently removed. The invention 100 is placed in the corner 163 of the pillow 161 casing 162 in such a manner that the invention 100 stiffens the pillow 161 casing 162 such that the pillow 161 casing 162 does not appear "floppy."

The cover 101 comprises a plurality of panels 111 and a plurality of seams 112. The cover 101 is a pyramidal structure. As shown most clearly, each of the plurality of panels 111 is a sheeting. The plurality of panels 111 will always comprise a base panel 120 and a plurality of face panels 117. The base panel 120 is the portion of the cover 101 that forms the base of the pyramidal structure. The shape of the base panel 120 is selected from the group consisting of an N-gon, a circle, or an ellipse. The base panel 120 and is further defined with a perimeter or circumference 141. Each of the plurality of face panels 117 forms a side of the pyramidal structure of the cover 101.

The plurality of face panels 117 comprises two or more panels. Each of the plurality of face panels 117 is identical. Each of the plurality of face panels 117 is formed with a triangular shape. Each of the plurality of face panels 117 is further defined with an alpha edge 114, a beta edge 115, and a gamma edge 116. A first seam 131 selected from the plurality of seams 112 attaches the alpha edge 114 of every first panel 121 selected from the plurality of face panels 117 to the beta edge 115 of a second panel 122 selected from the plurality of face panels 117. A second seam 132 selected from the plurality of seams 112 attaches the beta edge 115 of every first panel 121 selected from the plurality of face panels 117 to the alpha edge 114 of a second panel 122 selected from the plurality of face panels 117. A subsequent seam selected from the plurality of seams 112 attaches the gamma edge 116 of every panel selected from the plurality of face panels 117 to the base panel 120. The above described attachments are formed for each of the plurality of face panels 117 to form the cover 101. Seams suitable for use in the plurality of seams 112 include, but are not limited to, sewn seams, heat bonded seams, or ultrasonically bonded seams.

The bung 103 is a bung shaped object that provides structural stability for the invention 100. The bung 103 provides the basic shape of the invention 100 around which the padding 102 and the cover 101 are draped. Bungs 103 are commercially available and are often marketed as neoprene cones, tapered rubber stoppers, or tapered rubber collars. Bungs 103 can be readily fabricated from commonly available materials. The bung 103 is a semi-rigid structure. The bung 103 deforms when a force, such as the weight of a head, is applied to the bung 103. The bung 103 may be formed from a non-elastic semi-rigid material such as polystyrene. Alternatively, the bung 103 may be formed from an elastic material that returns to its original shape. The bung 103 is attached to the base panel 120 such that the center axis of the bung 103 is aligned with the center of the base panel 120 such that the center axis of the bung 103 is perpendicular to the surface of the base panel 120. The bung 103 is attached to the base panel 120 with a commercially available fastener 113.

The padding 102 is a commercially available padding material that is used to fill the space between the bung 103 and the plurality of panels 111 to provide the invention 100 with its final shape. Suitable materials for use as the padding 102 include, but are not limited to, a polyester fill often referred to as fiberfill or polystyrene beads often referred to as stuffing beans or as bean bag chair beans.

Figure 4:
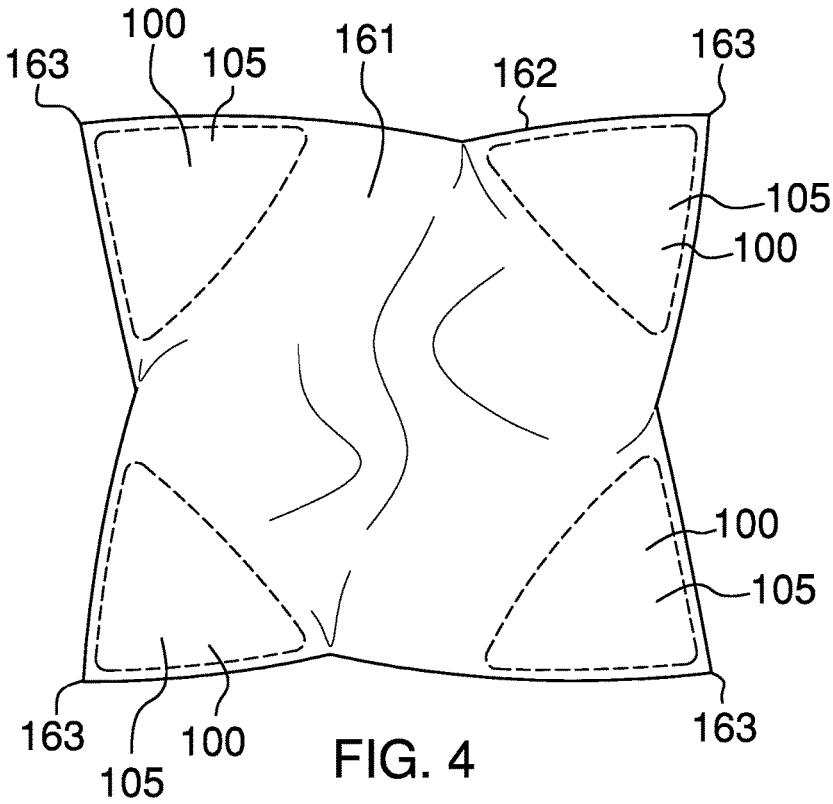
FIG. 4 is an in use view of an embodiment of the disclosure.
Figure 5:
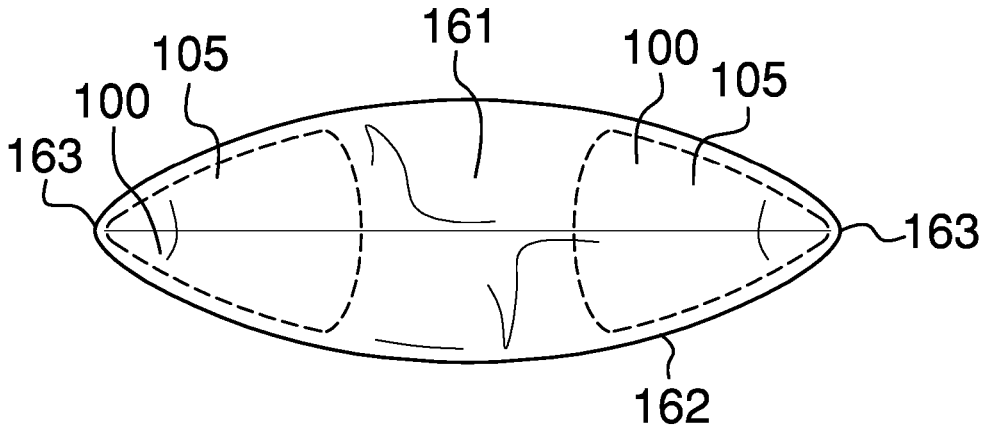
FIG. 5 is a top view of an embodiment of the disclosure.

As shown most clearly in FIGS. 4 and 5, it is anticipated that the invention 100 will be used in a kit 105 form wherein the kit 105 comprises a plurality of instantiations of the invention 100. In this scenario, an instantiation of the invention 100 is selected from the kit 105 and is inserted into interior of the pillow 161 casing 162 such that: 1) the instantiation of the invention 100 in inserted between the pillow 161 and a selected corner 163 of the pillow 161 casing 162; and, 2) the vertex 142 of the cover 101 is proximal to the selected corner 163 of the pillow 161 casing 162.

Figure 6:
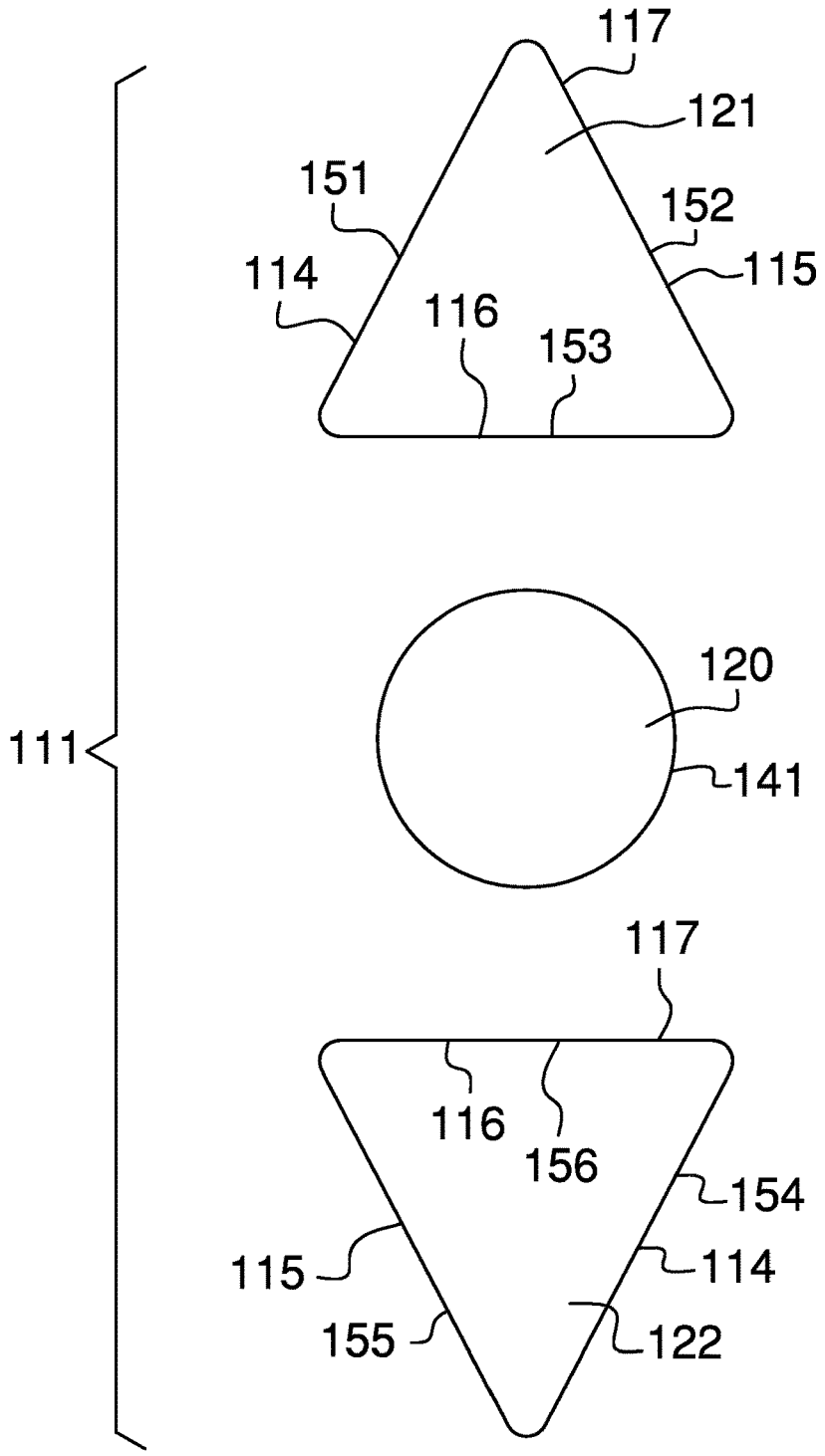
FIG. 6 is a detail view of an embodiment of the disclosure.
Figure 7:
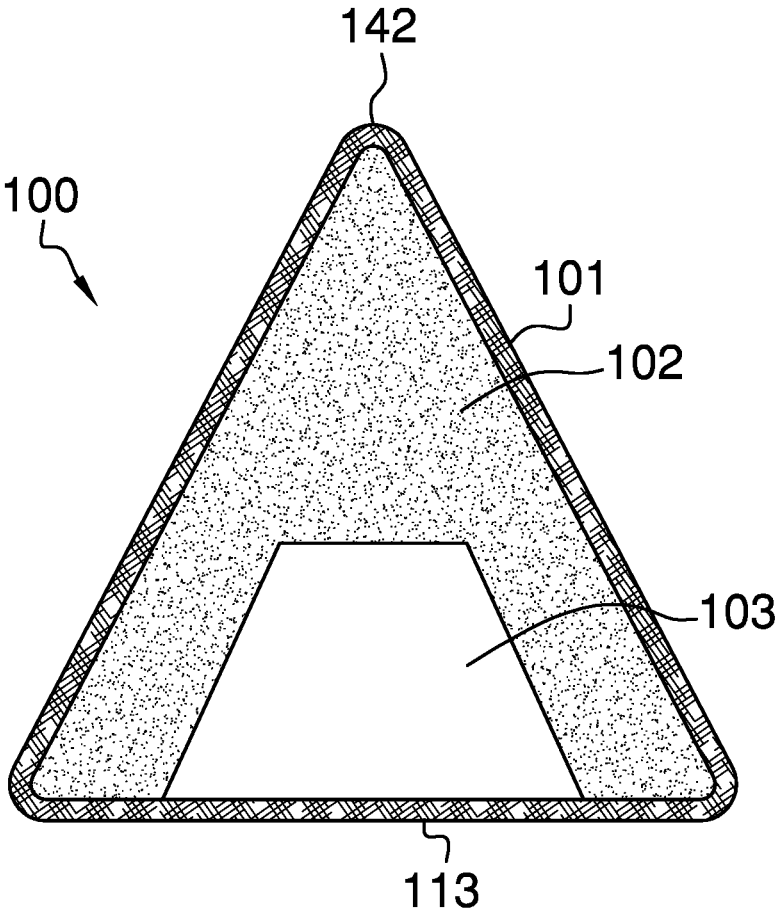
FIG. 7 is a detail view of an embodiment of the disclosure.
Figure 8:
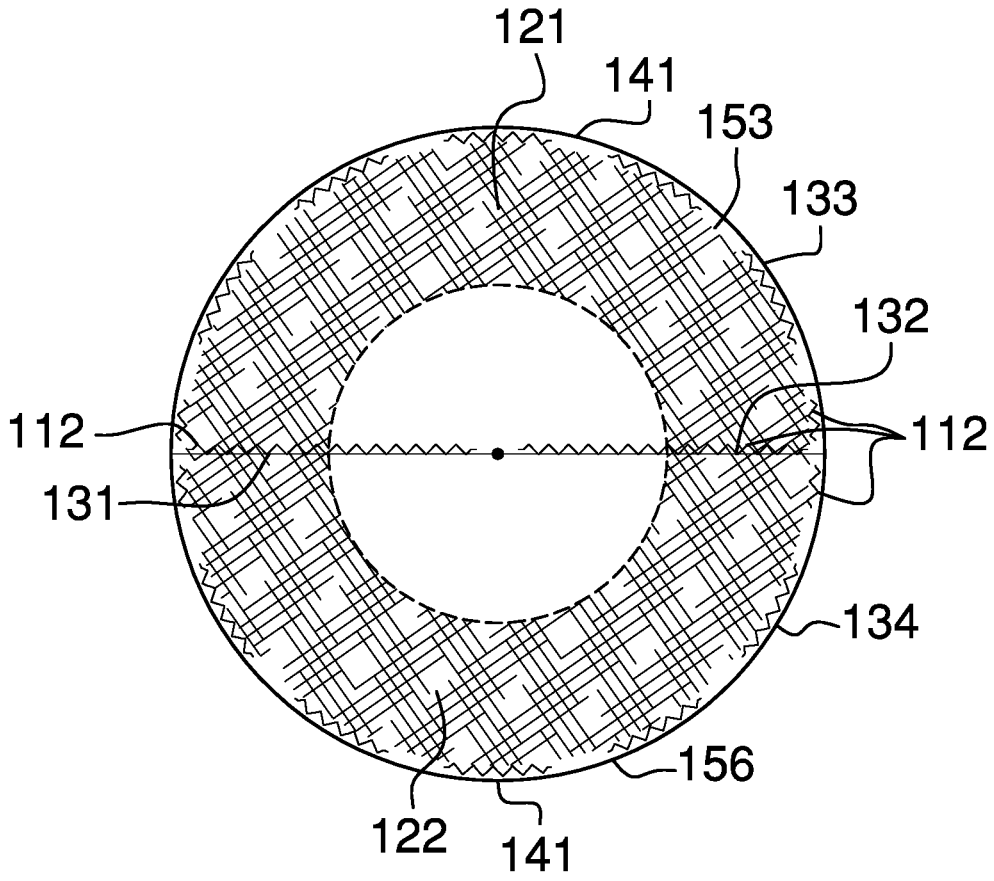
FIG. 8 is a detail view of an embodiment of the disclosure.

The assembly of a first potential embodiment of the disclosure, as shown most clearly in FIGS. 6 through 8, is described in this paragraph and the following 2 paragraphs. The padding 102 is a polyester fill material. The bung 103 is a polystyrene cone that has had the apex cut off. Each of the plurality of panels 111 is a readily and commercially available textile. Each of the plurality of seams 112 is a sewn seam. The fastener 113 is a cyanoacrylate adhesive.

The plurality of panels 111 further comprises the base panel 120 and the plurality of face panels 117. The plurality of face panels 117 comprises a first panel 121, and a second panel 122. The base panel 120 is cut in the shape of a circle. The base panel 120 is further defined with a circumference 141. The first panel 121 is further defined with a first edge 151, a second edge 152, and a third edge 153. The first edge 151, the second edge 152, and the third edge 153 are, respectively, the alpha edge 114, the beta edge 115, and the gamma edge 116 of the first panel 121. The second panel 122 is further defined with a fourth edge 154, a fifth edge 155, and a sixth edge 156. The fourth edge 154, the fifth edge 155, and the sixth edge 156 are, respectively, the alpha edge 114, the beta edge 115, and the gamma edge 116 of the second panel 122. The plurality of seams 112 further comprises a first seam 131, a second seam 132, a third seam 133, and a fourth seam 134.

The bung 103 is attached to the base panel 120 and surrounded with the padding 102. The first seam 131 joins the first edge 151 of the first panel 121 to the fifth edge 155 of the second panel 122. The second seam 132 joins the second edge 152 of the first panel 121 to the fourth edge 154 of the second panel 122. The bung 103 and the padding 102 are inserted into the interior space formed between the first panel 121 and the second panel 122. The third seam 133 joins the third edge 153 of the first panel 121 to the circumference 141 of the base panel 120. The fourth seam 134 joins the sixth edge 156 of the second panel 122 to the circumference 141 of the base panel 120.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Bung: As used in this disclosure, a bung is a frustum of a cone wherein the parallel planes that form the frustum are perpendicular to the center axis of the cone.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two-cylinder or like structures share the same line they are said to be aligned. When the center axes of two-cylinder like structures do not share the same line they are said to be offset.

Cone: As used in this disclosure, a cone is a surface that is generated by rotating a triangle around one of the legs of the triangle. If a line that is perpendicular to the base that is drawn from the center of the base goes through the vertex of the triangle then the cone is called a right cone. A cone is a type of quadric surface. The cone is a pyramid with a circular base.

Diameter: As used in this disclosure, a diameter of an object is a straight-line segment that passes through the center of an object. The line segment of the diameter is terminated at the perimeter or boundary of the object through which the line segment of the diameter runs.

Elastic: As used in this disclosure, an elastic is a material or object that deforms when a force is applied to it and that is able to return to its original shape after the force is removed. A material that exhibits these qualities is also referred to as an elastomeric material.

Exterior: As used in this disclosure, the exterior is use as a relational term that implies that an object is not contained within the boundary of a structure or a space.

Frustum: As used in this disclosure, a frustum is a portion of a solid that lies between two parallel planes that intersect with the solid.

Interior: As used in this disclosure, the interior is use as a relational term that implies that an object is contained within the boundary of a structure or a space.

N-gon: As used in this disclosure, an N-gon is a regular polygon with N sides wherein N is a positive integer number greater than 2.

Pad: As used in this disclosure, a pad is a mass of soft material used as a filling or for protection against damage or injury. Commonly used padding materials include, but are not limited to, a polyester fill often referred to as fiberfill or polystyrene beads often referred to as stuffing beans or as bean bag chair beans.

Perimeter: As used in this disclosure, a perimeter is one or more curved or straight lines that bounds an enclosed area on a plane or surface. The perimeter of a circle is commonly referred to as a circumference.

Pyramid: As used in this disclosure, a pyramid is a three dimensional shape that comprises a base formed in the shape of an N-gon (wherein N is an integer) with N triangular faces that rise from the base to meet at a point above the base. If the point where the N faces meet is positioned such that a line drawn from the point where the N faces meet to the center of the N-gon base is perpendicular to the N-gon base, the pyramid is referred to as a right pyramid. Pyramids can be further formed with circular or elliptical bases, which are commonly referred to as cone or an elliptical pyramid respectively.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, or an ultrasonically bonded seam.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as cloth or plastic in the form of a thin flexible layer or layers.

Textile: As used in this disclosure, a textile is a material that is woven, knitted, braided or felted. Synonyms in common usage for this definition include fabric and cloth.

Vertex: As used in this disclosure, a vertex (plural vertices) is an angle that is formed by two lines that form a point. Vertices are commonly found in polygons.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An accessory comprising:

a cover, a padding, and a bung;

wherein the padding and the bung are contained within an interior of the cover;

wherein the accessory is an insert that is adapted for use with a pillow;

wherein the pillow is contained within a pillow casing;

wherein the pillow casing is further defined with one or more corners;

wherein the accessory is inserted into a combination of the pillow contained within the pillow casing such that the accessory can be subsequently removed;

wherein the accessory is placed in a corner selected from the one or more corners of the pillow casing;

wherein the cover comprises a plurality of panels and a plurality of seams;

wherein the cover is a pyramidal structure;

wherein each of the plurality of panels is a sheeting;

wherein the plurality of panels comprise a base panel and a plurality of face panels;

wherein the plurality of face panels attach to the base panel using seams selected from the plurality of seams;

wherein each of the plurality of face panels are interconnected using seams selected from the plurality of seams;

wherein each of the plurality of face panels forms a side of the pyramidal structure of the cover;

wherein the base panel forms the base of the pyramidal structure.

2. The accessory according to claim 1 wherein the shape of the base panel is selected from the group consisting of an N-gon, a circle, or an ellipse;

wherein the base panel and is further defined with a perimeter or circumference;

wherein the plurality of face panels comprises two or more panels;

wherein each of the plurality of face panels is identical;

wherein each of the plurality of face panels is formed with a triangular shape;

wherein each of the plurality of face panels is further defined with an alpha edge, a beta edge, and a gamma edge.

3. The accessory according to claim 2 wherein a first seam selected from the plurality of seams attaches the alpha edge of every first panel selected from the plurality of face panels to the beta edge of a second panel selected from the plurality of face panels;

wherein a second seam selected from the plurality of seams attaches the beta edge of every first panel selected from the plurality of face panels to the alpha edge of a second panel selected from the plurality of face panels;

wherein a subsequent seam selected from the plurality of seams attaches the gamma edge of every panel selected from the plurality of face panels to the base panel.

4. The accessory according to claim 3 wherein each of the plurality of seams is selected from the group consisting of a sewn seams, a heat bonded seam, or an ultrasonically bonded seam.

5. The accessory according to claim 4
wherein the bung is a bung shaped in the form of a frustum of a cone;
wherein the padding and the cover are draped over the bung;
wherein the bung is a semi-rigid structure.

6. The accessory according to claim 5
wherein the bung is attached to the base panel such that a center axis of the bung is aligned with a center of the base panel;
wherein the bung is attached to the base panel such that the center axis of the bung is perpendicular to a surface of the base panel;
wherein the bung is attached to the base panel with a fastener.

7. The accessory according to claim 6 wherein the padding fills the space between the bung and the plurality of panels to provide the accessory with its final shape.

8. The accessory according to claim 7
wherein a plurality of instantiations of the accessory form a kit;
wherein an instantiation of the accessory selected from the kit and is inserted into interior of the pillow casing such that the instantiation of the accessory in inserted between the pillow and a corner selected from the one or more corners of the pillow casing;
wherein the selected instantiation of the accessory is inserted into interior of the pillow casing such that a vertex of the cover is proximal to the selected corner of the pillow casing.

9. The accessory according to claim 8 wherein the bung is formed from a material selected from the group consisting of a non-elastic semi-rigid material or an elastic material that returns to its original shape.

10. The accessory according to claim 9 wherein the padding comprises a material selected from the group consisting of a polyester fill or plurality of polystyrene beads.

11. The accessory according to claim 3
wherein each of the plurality of panels is a textile;
wherein each of the plurality of seams is a sewn seam;
wherein the plurality of face panels comprises a first panel, and a second panel;
wherein the first panel is further defined with a first edge, a second edge, and a third edge;
wherein the first edge, the second edge, and the third edge are, respectively, the alpha edge, the beta edge, and the gamma edge of the first panel;
wherein the second panel is further defined with a fourth edge, a fifth edge, and a sixth edge;
wherein the fourth edge, the fifth edge, and the sixth edge are, respectively, the alpha edge, the beta edge, and the gamma edge of the second panel.

12. The accessory according to claim 11 wherein the base panel is cut in the shape of a circle;
wherein the bung is shaped in the form of a frustum of a cone;
wherein the padding and the cover are draped over the bung;
wherein the bung is a semi-rigid structure;
wherein the bung is attached to the base panel such that a center axis of the bung is aligned with a center of the base panel;
wherein the bung is attached to the base panel such that the center axis of the bung is perpendicular to a surface of the base panel;
wherein the bung is attached to the base panel with a fastener.

13. The accessory according to claim 12
wherein the plurality of seams further comprises a first seam, a second seam, a third seam, and a fourth seam;
wherein the first seam joins the first edge of the first panel to the fifth edge of the second panel;
wherein the second seam joins the second edge of the first panel to the fourth edge of the second panel.

14. The accessory according to claim 13
wherein the bung is attached to the base panel and surrounded with the padding;
wherein the bung and the padding are inserted between the first panel and the second panel.

15. The accessory according to claim 14
wherein the third seam joins the third edge of the first panel to the circumference of the base panel;
wherein the fourth seam joins the sixth edge of the second panel to the circumference of the base panel.

16. The accessory according to claim 15
wherein a plurality of instantiations of the accessory form a kit;
wherein an instantiation of the accessory selected from the kit and is inserted into interior of the pillow casing such that the instantiation of the accessory in inserted between the pillow and a corner selected from the one or more corners of the pillow casing;
wherein the selected instantiation of the accessory is inserted into interior of the pillow casing such that a vertex of the cover is proximal to the selected corner of the pillow casing.

17. The accessory according to claim 16
wherein the fastener is a cyanoacrylate adhesive;
wherein the padding is a polyester fill material;
wherein the bung is a polystyrene cone that has had an apex cut off.

18. The accessory according to claim 16 wherein the bung is formed from a material selected from the group consisting of a non-elastic semi-rigid material or an elastic material that returns to its original shape.

19. The accessory according to claim 18 wherein the padding comprises a material selected from the group consisting of a polyester fill or plurality of polystyrene beads.

* * * * *